United States Patent [19]

Ahlers

[11] 4,205,502

[45] Jun. 3, 1980

[54] ROTARY BOTTLE CLOSING MACHINE

[75] Inventor: Egon Ahlers, Bad Kreuznach, Fed. Rep. of Germany

[73] Assignee: Seitz-Werke GmbH, Bad Kreuznach, Fed. Rep. of Germany

[21] Appl. No.: 906,989

[22] Filed: May 17, 1978

[30] Foreign Application Priority Data

May 17, 1977 [DE] Fed. Rep. of Germany ..... 2722254

[51] Int. Cl.[2] ..... B67B 3/06; B65B 7/28; B67B 3/12

[52] U.S. Cl. ..... 53/308; 53/331; 53/343; 53/367

[58] Field of Search ..... 53/306, 308, 304, 331, 53/341, 343, 359, 357, 358, 367, 368

[56] References Cited

U.S. PATENT DOCUMENTS

| | | | |
|---|---|---|---|
| 1,041,527 | 10/1912 | Taylor | 53/343 X |
| 1,162,702 | 11/1915 | Lindsay | 53/368 X |
| 1,260,392 | 3/1918 | Kaye | 53/306 |
| 1,397,617 | 11/1921 | Belden | 53/368 |
| 1,748,960 | 3/1930 | Risser | 53/343 X |
| 2,030,188 | 2/1936 | Smith | 53/343 X |
| 2,842,917 | 7/1958 | Parodi | 53/343 X |
| 3,807,133 | 4/1974 | Simonazzi | 53/306 |

FOREIGN PATENT DOCUMENTS

| | | | |
|---|---|---|---|
| 458182 | 7/1949 | Canada | 53/367 |

*Primary Examiner*—Horace M. Culver
*Attorney, Agent, or Firm*—Becker & Becker

[57] ABSTRACT

A rotary closing machine for closing bottles with mouth lips by closures such as closure caps, corks and the like, which includes a supply container for receiving and supplying closures of the just mentioned type, and also includes a conveying device for feeding the content of the supply container to closing units having closing elements which are adapted to be lifted and lowered in the process of closing the bottles by the closure caps or the like closures. For pressing the closures, e.g. closure caps, against the respective bottle mouths and permanently deforming the closures on the bottle mouth, each closing unit has a deforming member and a holding down member extending through the deforming member; these two members are movable relative to each other. The device furthermore comprises a rotatable element associated with the conveying device for transferring the closures from the conveying device to a holding device at the lower end of the holding down member. There is furthermore provided a centering member common to the respective closure and the respective bottle mouth. This centering member is arranged coaxially with and below the deforming member and has a lower end surface which during the closure transfer is located in, or in the region of, the plane of the lower end of the holding down member.

9 Claims, 6 Drawing Figures

Fig. 4
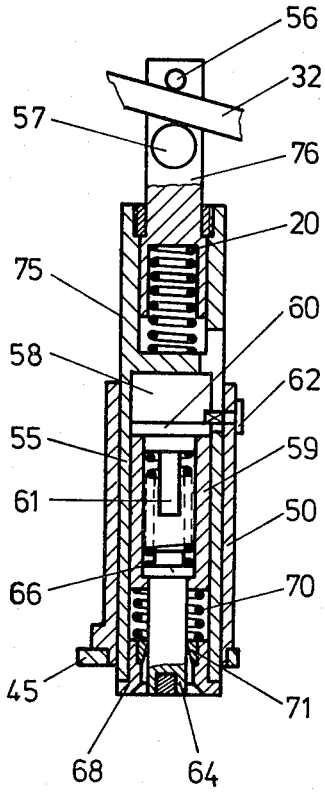
Fig. 5
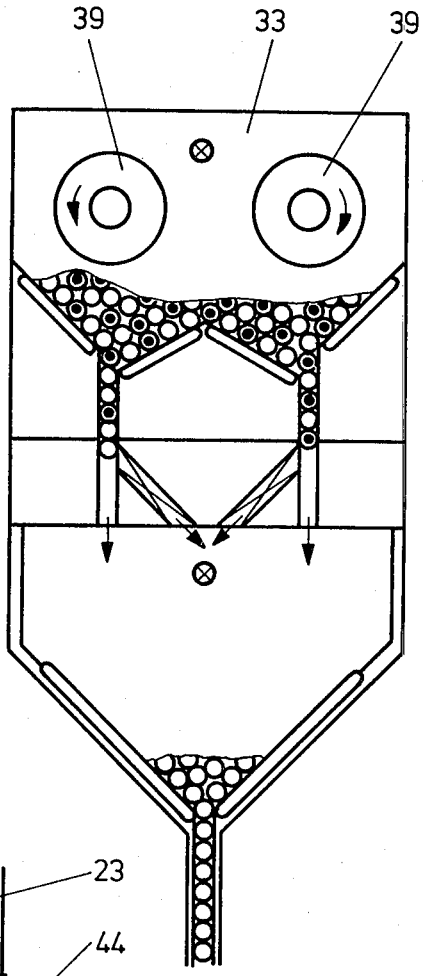
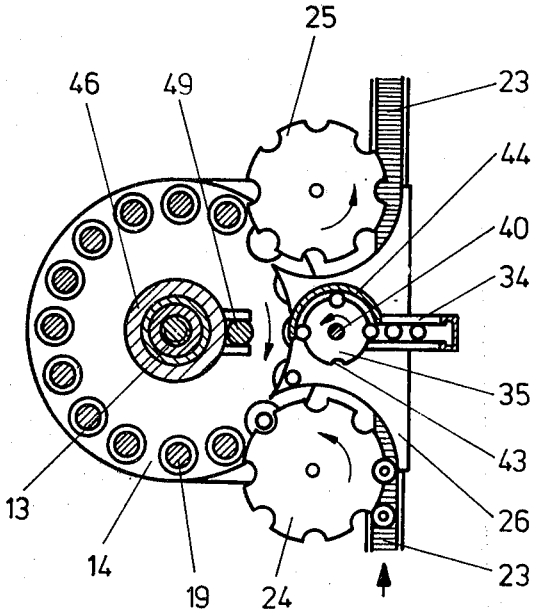
Fig. 6

ROTARY BOTTLE CLOSING MACHINE

The present invention relates to a closing machine of the rotary type for closing the mouth lips of bottles with closure caps such as crown closures, crown corks, or the like which are supplied from a supply container and subsequent supply conveyor. The invention more specifically concerns closing machines by which said closing of the mouth lips with closure caps is carried out by a plurality of closing elements which are lifted and lowered in vertical direction. For pressing on and subsequently permanently deforming said caps on the bottle mouth the closing elements are respectively provided with deforming members movable relative to each other and respectively having a holding down member which extends centrally through the deforming member. An element following the closure supply path rotates and transfers the closure caps to a holding member at the lower end of the holding down member.

With the above mentioned closing machines which within a bottle-filling installation are used individually or in combination with a filling machine, and if desired with additional treating machines combined as a unit, it has become known from the German Offenlegungsschrift No. 21 47 770, to bring about the required centering of bottle mouths and the closure cap conveyed to the holding means at the holding down member, merely by a guiding device engaging the bottle neck. This guiding device primarily comprises a disc which rotates below the closing elements and is provided at its outer rim with a plurality of bottle recesses, and furthermore comprises a stationary annular counterbearing.

This simple centering device is limited only to the bottle neck and is subjected to considerable wear. Therefore, this device requires substantially constant bottle types with pronounced bottle neck. Consequently already the processing of nowadays customary short-necked bottles causes difficulties or is entirely impossible. In view of the lack of centering of the caps on the holding means of the down-holding member, there furthermore exists the danger that eccentrically received caps are pressed in inclined position upon the bottle mouth whereby non-tight closures as well as damaged bottle mouths may occur.

It is, therefore, an object of the present invention with closing machines of the above mentioned type, by centering the bottles at the more precise bottle mouth as well as by centering the caps on the holding means of the down-holding member for all practical purposes to exclude non-tight bottle closures and to increase the output of such machines.

These and other objects and advantages of the invention will appear more clearly from the following specification in connection with the accompanying drawings, in which.

Figure 2:
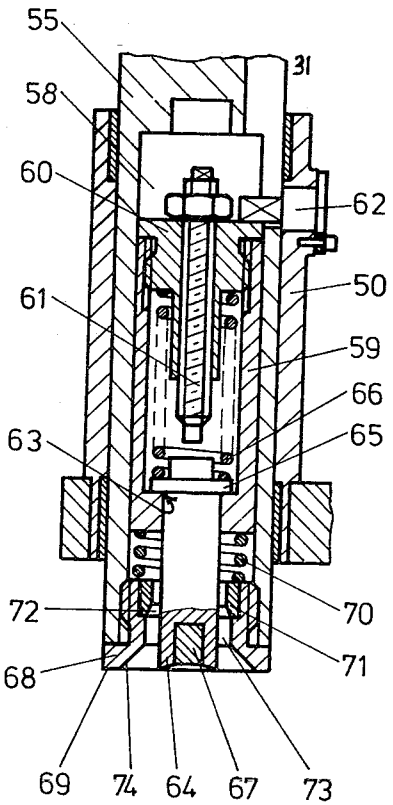
FIG. 2 is a longitudinal section through a closing element of the machine of FIG. 1.

FIGS. *3a-3e* represent phases of the centering and closing operation with the closing element of FIG. 2.

FIG. 4 represents a longitudinal section through a further embodiment of a closing element.

Figure 1:
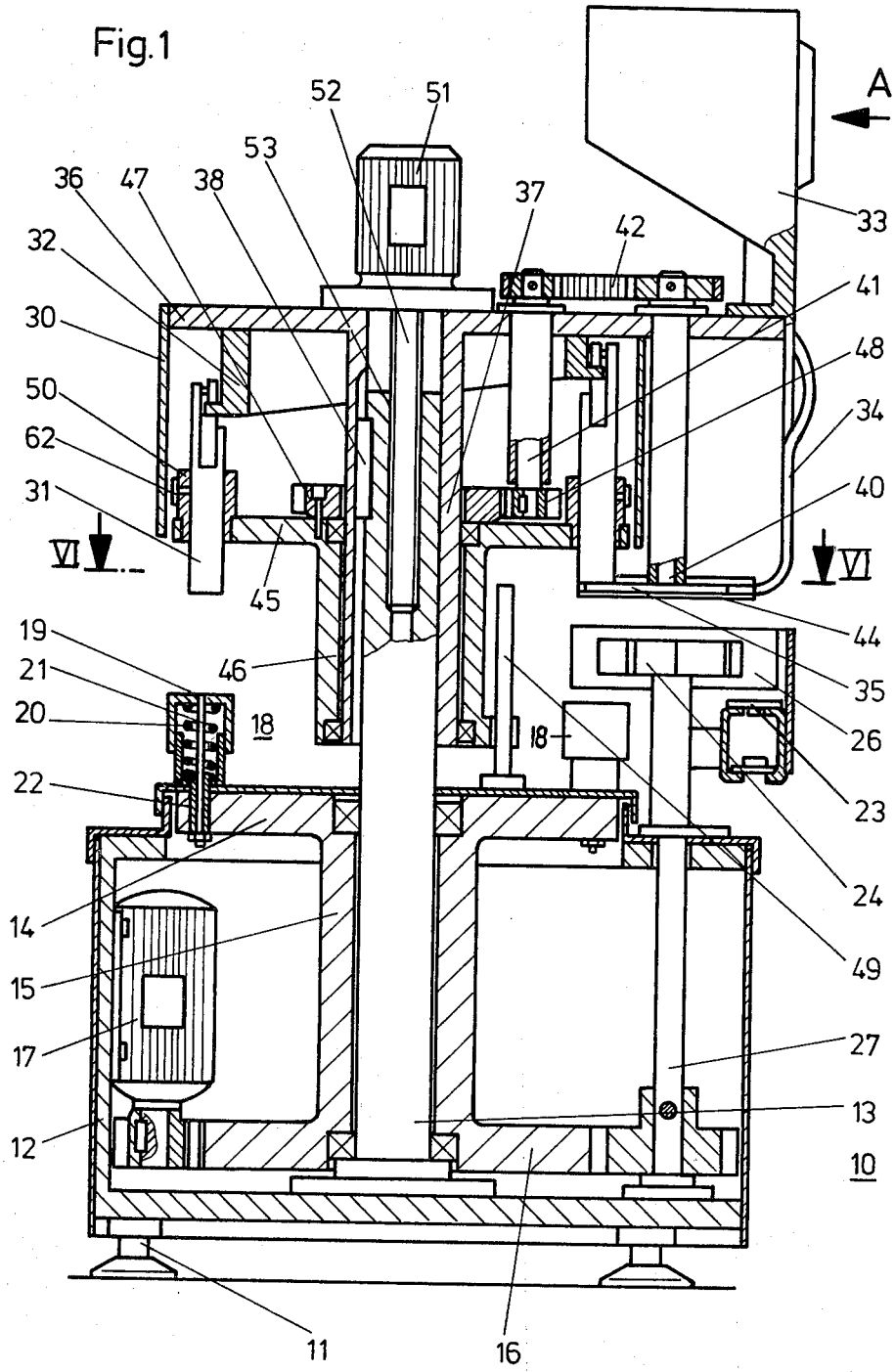
FIG. 1 represents a longitudinal section through a closing machine according to the invention.

FIG. 5 is the supply container supplying the corks or closure members and is provided with a feeding path for the corks or closure members, FIG. 5 being seen in the direction of arrow A of FIG. 1.

FIG. 6 shows the cork or closure member transfer to the closure elements and represents a section taken along the line VI—VI of FIG. 1.

The closing machine according to the present invention is characterized primarily in that the centering member at the bottle related end of the element housing is coaxially arranged below the deforming member. The centering member comprises a cylindrical bore which is determined by the rim diameter of the nondeformed closure caps. The flares bore conically in the direction toward the lower limiting surface. The lower limiting surface of said centering member is located in or within the region of the plane of the lower end of the down-holding member.

The design according to the present invention brings about that with the starting of the closing operation in connection with the occurring downward movement of the closing elements, the bottle at the closing neck and the closure cap at the holding means of the holding-down member are respectively centered and centrically arranged with regard to each other. Consequently, the forming of the closure by the subsequently effective deforming member on the closure cap properly pressed on the mouth of the bottle can be effected and tight closures will be assured while damage to the mouth will be excluded.

According to the invention, the centering member at the bottle related end of the element housing is arranged coaxially below the deforming member and comprises a cylindrical bore which is determined by the rim diameter of the nondeformed closure caps. The said cylindrical bore flares conically in the direction toward the lower limiting surface.

According to a preferred embodiment of the invention, the centering member is expediently designed as a bushing which comprises the cylindrical bore and said conical flaring section. At the lower end of the element housing, the bushing forms the closure for the housing bore and expediently is detachably connected to the element housing.

According to a further development of the invention, it is provided that the bushing forms a common unit with the deforming member which is arranged coaxially with said bushing above the cylindrical bore. According to a further development of the invention, this last mentioned design is realized by forming the deforming element in the shape of a ring having a bore which tapers in upward direction. The deforming member with said tapering bore is firmly inserted into the bushing while forming a continuation of the cylindrical bore. In this connection, according to the invention the upper limitation of the bushing may form the counterbearing for the lower end of a spring force which supports a bearing body for the holding-down member, an adjustable abutment for limiting the displacement in height, and spring force acting upon the holding-down member. The holding-down member is longitudinally displaceably arranged in the housing bore relative to the element housing and, when the spring force is under load, engages an abutment of the element housing guiding means. When the spring force is relaxed, the holding-down member engages the upper confinement of the housing bore.

Referring now to the drawings in detail, the closing machine 10 comprises a lower section 12 with a vertical column 13. The lower section 12 includes an adjustable foot portions 11 which rests upon a supporting surface. The column 13 is fixedly mounted in the lower section 12 and extends through a machine table 14 which forms the upper confinement of the lower section 12. The table 14 is drivingly connected to a driving motor 17 by way of a hollow shaft 15 which is connected to the table 14 and surrounds the column 13. The lower end of hollow shaft 15 carries a gear 16. The table 14 supports a plurality of elements 18 for depositing the bottles. The elements are connected near the circumference of the table in evenly spaced arrangement from each other. With the depositing elements 18 each comprising a bushing-like lower and upper section, the upper section is provided with a bottle dish 19. A guiding rod 21 slides against a spring force 20 which compensates for the closure pressure as well as the differences in height within one and the same bottle type, in a bearing 22 of rod 21 on the stationary bottom section. In the normal position of said elements 18, the bottle dishes 19 are all located in the same plane with the transporting surface of a conveyor belt 23 associated with a closing machine 10. Within the region of the belt 23 above its transporting surface, the machine 10 is further equipped with a turnstile 24 and 25 for the bottle inlet and bottle outlet respectively. The machine is furthermore equipped with a bottle guiding device 26 respectively having guiding curves located opposite said turnstiles 24 and 25 (FIG. 6). The turnstiles 24 and 25 are connected to vertical shafts 27 which are mounted in the lower section 12 where they are drivingly connected to the gear 16.

The machine upper section 30 primarily comprises the closure elements 31, the curved path 32 thereof, the cork or cap supply container 33, the cork or cap feeding path 34, and the cork or cap transfer member 35. As carrier for these elements there is provided a horizontal plate 36 which has a vertical pipe extension 37. Plate 36 by means of the extension 37 is movably mounted on column 13 for varying its level. A groove-key element 38 prevents the plate 36 from turning relative to the column 13. The top side of plate 36 supports the supply container 33 with the feeding path 34 joined thereto, said supply container 33 being equipped with two sorting mechanisms 39 (FIG. 5).

Mounted on the bottom side of plate 36 is a track 32. Plate 36 furthermore forms the bearing for two vertical shafts 40 and 41 which at those ends thereof which project upwardly beyond plate 36 are interconnected by a tooth belt drive 42. To the lower end of shaft 40 there is connected a circular cork or cap transfer member 35 which is located within the region of the transfer section of the cork or cap feeding path 34 and which at the circumference thereof comprises a plurality of follower members 43. A cork or cap guiding device 44 surrounds an element 35 at the circumference and the two disc surfaces, said element 35 being rotatable in a horizontal plane. The cork or cap guiding device 44 extends over the rotating path of the member 35 from the cork or cap take-over at the feeding path 34 to the cork or cap transfer to the elements 31 (FIG. 3).

A circular table 45 below the plate 36 serves for receiving the closing elements 31. The table 45 is likewise provided with a vertical tubular extension 46 which surrounds the extension 37 and is rotatably mounted thereon. The topside of the table 45 rotatable with the extension 46 carries a gear 47 which is fixedly connected thereto and which is engaged by a pinion 48 of shaft 41. The gear 47 by way of a follower member 49 is drivingly connected to the machine table 14. At the circumference of the table 45, respectively opposite the bottle dishes 19 of a depositing element 18 there are provided vertical fixedly arranged guiding means 50 for receiving the closing elements 31.

For processing bottles of different sizes, the top section 30 of the machine is adjustable as to height. The height adjusting device comprises a threaded spindle 52 which is adapted to be driven by a driving motor 51 connected to the plate 36. The spindle 52 extends in an axial threaded bore 53 provided in the upper portion of column 13.

Figure 3:
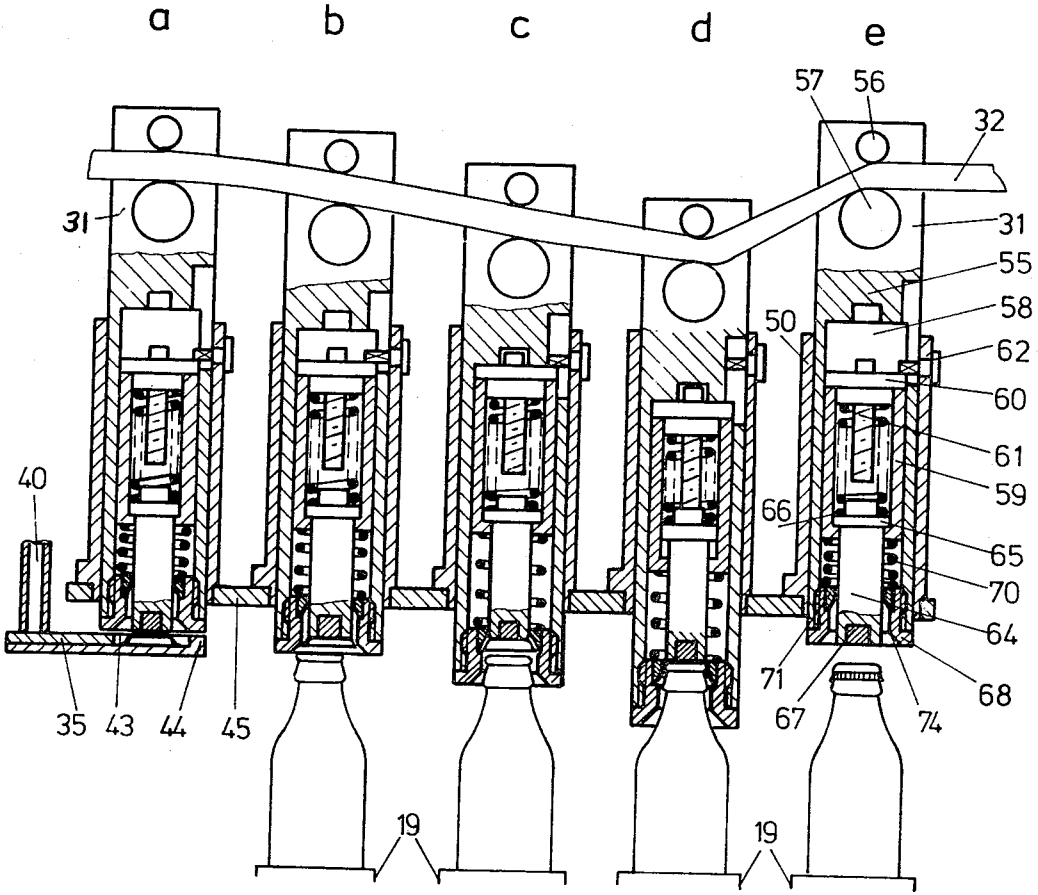

As will be seen from FIGS. 2 and 3, the closing elements 31 adapted to be lifted and lowered comprise a bushing shaped housing 55 which extends through the pertaining guiding means 50. The upper end of housing 55 supports rollers 56 and 57 which are located opposite to each other and respectively roll on the upper and lower side of the track 32. Within an axial bore 58 forming the interior of the housing, a bearing body 59 is slidably arranged. This bearing body 59 has its upper end provided with a closing member 60 which comprises a threaded bolt 61 axially extending into the interior of the body and adjustable as to height. An abutment 62 arranged on guiding means 50 engages the housing bore 58 above the closing member 60. The said abutment 62 prevents the housing 55 from turning relative to the stationary guiding means 50 and limits the upward movement of the body 59. The oppositely located end of body 59 comprises a passage 63 for a stamp-like holding-down member 64 which is longitudinally displaceably arranged in bore 63 and by means of a collar 65 arranged at its upper end extends into the interior of the body 59, and with the opposite end extends downwardly out of the bore 63. The holding-down member 64 is acted upon by a spring force 66 for which the counterbearing is formed by the closing member 60 and collar 65. In connection with the bore extension 63, the collar 65 simultaneously forms the lower limit for the axial displacement of the holding-down device 64.

The lower end of the holding-down device 64 has a centrally inserted cork or cap holding means in the form of a permanent magnet 67. This lower end of the down-holding device 64 extends with lateral play axially within a cap deforming member located in the lower housing end 55 and within the coaxially adjacent centering member for the caps and the bottle mouth.

The centering member is expediently designed as bushing 68 and is connected and detachably arranged in the lower housing end 55. In the normal position of the closing element 31, the lower end of the down-holding device 64 is located in or within the region of the plane of the lower confining surface 69 of bushing 68. A further spring force 70 surrounds the holding-down member 64 and is inserted in the housing 55 between the bushing 68 and the body 59.

One spring end engages the top side of bushing 68 whereas the other spring end engages the lower confinement of the body 59 supported by the spring 70. The deforming member 71 inserted into the top side of bushing 68 is expediently annularly formed and is provided with an upwardly tapering conical bore 72. The largest diameter of bore 72 is located at the lower end and is determined by the outer diameter of the respective crown cork or cap to be processed before it is deformed, measured over the crown rim. The conicity itself of the bore 72 is so selected that approximately when reaching the conical inner surface, the crown deformation is completed. For purposes of centering corks and bottle mouths, the upper portion of the bushing 68 is provided with a cylindrical bore 73 which is coaxial with the conical bore 72 of the deforming member 71. The diameter of the bore 73 is likewise determined by the outer diameter of the non-deformed crown cork, and ends downwardly in the confining surface 69 with a conical widened portion 74. In the preferred common design of deforming member and centering member to form a single structural unit, both bores 72 and 73 merge with each other in an edge-free manner, and if desired, with the provision of a slight radius. The operation of the device is as follows: when the closing machine rotates after it has been set for the respective bottle size by means of the adjusting devices 51, 52, the crown corks or caps one after the other leave the supply container 33 while said corks or caps have their inward side directed downwardly; the said corks or caps pass by means of the feed path 34 into the cork or cap guiding means 44 of the transfer member 35 which is subjected to a rotary movement by the drive 47, 48, 41, 42, 39. During its circulatory path below the circular path of the closing element 31, the transfer member 35 respectively transfers one cork or cap received from the follower member 43 to a closing element 31 which at the contact point of the two circles occupies its starting position. The body 59 under the influence of the loaded spring force 70 has its closing member 60 engage the abutment 62. The lower end of the holding-down member 64 is located in the plane of the lower confining surface 69 of bushing 68 (FIG. 3*a*). The cork or cap thus supplied from below toward the closing member 31 is taken over by the holding member 67 and is held at the holding-down member 64.

With the subsequent bottle feeding by belt 23 by way of the turnstile 24 to the bottle dish 19 and with the continuous rotation of the machine, the now downwardly inclined curved path 32 brings about the downward movement of the element housing 55 within the guiding means 50. As a result thereof, spring 70 relaxes, and the closing member 60 remains at the abutment 62 whereas the holding-down member 64 retains its starting position. In the course of this movement, the bushing 68, by means of its conical widened portion 74 engages the crown rim of the cork or cap and starts aligning the cork or cap at the holding means 67 with regard to the longitudinal axis of the element 31 (FIG. 3*b*). The centering of the cork or cap is subsequently effected by means of the cylindrical bore 73 and is completed as soon as in the course of a further downward movement of housing 55, the cylindrical bore 73 of bushing 68 has moved downwardly upon the crown rim or cap.

During the further downward movement of housing 55, the widened portion 74 first engages the mouth rim of the bottle to be closed and starts to align the latter with regard to the longitudinal axis of the element 31. Approximately up to this time or shortly thereafter, the deforming member 68 starts its downward movement upon the cap. In this connection, also the housing 55 engages the closure member 60. During the continued downward movement during which the closure member 60 detaches itself from the abutment 62 and the spring 70 is relaxed, together with the closure member 60 and the housing 55, also the holding-down member 64 with the cork is moved downwardly. The closure of the widening section 74 and subsequent thereto the bore 73 engage the bottle bead below the mouth lip whereby the centering of the bottle mouth relative to the cork or cap is effected and the cork during a further upward movement of the housing is subsequently deposited upon the mouth rim of the bottle. The holding-down member 64 thus finishes the common downward movement with the housing 55. This downward movement starts when the closing member 60 detaches itself from the abutment 62.

In the course of the downwardly moving housing 50 which moves downwardly further against the thrust of the spring force 66, the conical bore 72 of the deforming member 71 slips over the cork or cap rim and deforms the latter permanently about the mouth lip of the bottle. This deforming operation is completed as soon as the bolt 61 with its free end has been deposited upon the upper end of the downward holding member 64 (FIG. 3*d*) during the still further downward movement of the housing 55. The now closed bottle follows the housing 55. The bottle dish 19 of the depositing element 18 escapes against the said spring force 20 until the upward movement is completed, that is, when the deepest point of a track 32 has been reached. With subsequent upward movement of the element housing 55 by the movement of the rollers 56, 57 over the now ascending region of the track 32, first the members 68 and 71 are removed from the closed bottle, while the bottle dish occupies its starting position. Also the body 59 takes part in the upward movement of the housing. The body 59 is held by means of the spring force 70 together with the closure member 60 at the upper confinement of the housing bore 58. In this connection, also the lower end of bolt 61 is lifted off the upper end of the holding-down member 64, and spring 66 relaxes. The holding-down device 64 itself remains stationary and under the influence of the relaxing spring 66 keeps the closed bottle stationary until the bore extension 63 engages the collar 65, and the relaxing step of spring 66 is completed. When during the further upward movement of the housing, in which at this time also the holding-down member 64 takes part, the closure member 60 engages the abutment 62, the body 59 and the down-holding device 64 reach their starting positions. The starting position for the housing 55 is reached after further upward movement as soon as the lower confining surface 69 of bushing 68 has again arrived in the plane of the lower end of the holding-down device 64 (FIG. 3*e*). It will be appreciated that during said last mentioned upward movement, also spring 70 will relax.

After the machine has passed through the remaining section of its rotary course, on which the closed bottle by means of the turnstile 25 is removed from the machine and transferred to the belt 23, the element 31 is located within the region of the transfer member 35 and is again ready for receiving a cork or cap (FIG. 3*a*). Between the closing element 75 of FIG. 4 and the above described element 31 of FIG. 2, and more specifically as to the structure and operation thereof, there exists a difference insofar as with the element 75, in the upper portion of the element housing 55 there is located a spring force 20 for compensating for the closure pressure as well as the different bottle heights within a bottle type. For the element 31 the said spring force is located in the interior of the pertaining depositing elements 18. As a result thereof, with the element 75, for the rollers 56 and 57, there is provided a holding means 76 which is axially displaceably arranged with regard to housing 55. This holding means 76 is adapted by way of the spring force 20 to bring about the above described movements of the housing 55. In this way, with the depositing elements 18 of the machine 10, the spring compensation is not needed.

It is, of course, to be understood that the present invention is, by no means, limited to the specific showing in the drawings, but also comprises any modifications within the scope of the appended claims.

What I claim is:

1. A rotatable bottle closing machine for closing bottles with closures accurately centered therewith, especially bottle caps, crown closures and crown corks, which includes: a container for receiving and supplying closures for bottles having a mouth lip, a plurality of circularly arranged closing units for applying closures to bottles having a mouth lip, conveyor means for conveying closures from said container to said closing units, each of said closing units having a holding down member and a deforming member for respectively pressing a closure against a bottle mouth and permanently deforming said closure on the bottle mouth, said holding down member and said deforming member being movable relative to each other and said holding down member axially extending through said deforming member, a holding means arranged on said holding down member, a rotatable element associated with said conveyor means for transferring the closures one after another from said conveyor means to said holding means, a centering member common to both the respective closure to be applied and also the respective bottle mouth, said centering member being arranged coaxially with and centered below said deforming member and having a lower end surface, said lower end surface during a closure transfer from said conveyor means to said holding down member being located in planar alignment within the region of the lower end of said holding down member, means for moving said centering member downward relative to said holding down member to cause said common centering member to be engaged externally during lowering movement sequentially first against the respective closure and thereafter the respective bottle mouth.

2. A machine according to claim 1, in which each closing unit comprises a housing surrounding said holding down member and said deforming member, and in which the centering member is arranged at that end of said housing coaxially below said deforming member which is adjacent the bottle mouth to be provided with a closure, said centering member having a bore determined by the rim diameter of the non-deformed closure and conically flaring toward the adjacent end face of said centering member.

3. A machine according to claim 2, in which said centering member is formed as a bushing which at the lower end of said housing forms the outer end face of said bore.

4. A machine according to claim 3, in which said bushing is detachably connected to said housing.

5. A machine according to claim 3, in which said bushing forms a single structural unit with said deforming member.

6. A machine according to claim 5, in which said deforming member is annular and is fixedly inserted in said bushing.

7. A machine according to claim 5, in which said deforming member has a conical bore decreasing in diameter in upward direction.

8. A machine according to claim 3, which includes a first vertically extending spring arranged inside said housing and having its lower end supported by the upper end of said bushing, a bearing body likewise arranged in said housing and supported by the upper end of said first spring for supporting said holding down member, and abutment means limiting the upward movement of said bearing body and being longitudinally displaceable in said housing.

9. A machine according to claim 8, in which said housing has a vertical bore having said bearing body reciprocably mounted thereon, a closing member arranged at said upper end of said bearing body, a second spring arranged between said closing member and said holding down member, an adjustable threaded spindle supported by said closing member and extending into said bearing body, and an abutment extending into said vertical housing bore above said closing member.

* * * * *